US007252482B2

(12) United States Patent
Walker et al.

(10) Patent No.: US 7,252,482 B2
(45) Date of Patent: Aug. 7, 2007

(54) MOTOR DRIVEN PUMP WITH IMPROVED MOTOR COOLING AIR FLOW

(75) Inventors: John M. Walker, Carrollton, TX (US); Hsueh-Hsiung Hsieh, Carrollton, TX (US)

(73) Assignee: Beckett Corporation, Irving, TX (US)

( * ) Notice: Subject to any disclaimer, the term of this patent is extended or adjusted under 35 U.S.C. 154(b) by 233 days.

(21) Appl. No.: 10/924,693

(22) Filed: Aug. 24, 2004

(65) Prior Publication Data

US 2006/0045771 A1 Mar. 2, 2006

(51) Int. Cl.

| | |
|---|---|
| ***F04B 49/04*** | (2006.01) |
| ***F04B 35/04*** | (2006.01) |
| ***H02K 9/00*** | (2006.01) |

(52) U.S. Cl. ..... 417/40; 417/423.8; 310/63

(58) Field of Classification Search ..... 417/36, 417/40, 423.8; 310/63
See application file for complete search history.

(56) References Cited

U.S. PATENT DOCUMENTS

| | | | | |
|---|---|---|---|---|
| 3,758,236 | A * | 9/1973 | Zimmerman | 417/360 |
| 4,275,995 | A * | 6/1981 | Taylor | 417/40 |
| 5,293,894 | A | 3/1994 | Fleischmann | |
| 5,394,041 | A * | 2/1995 | Oberdorfer-Bogel | 310/64 |
| 6,107,041 | A * | 8/2000 | Korneluk et al. | 435/6 |
| 6,322,326 | B1 * | 11/2001 | Davis et al. | 417/40 |

* cited by examiner

*Primary Examiner*—Charles G. Freay
(74) *Attorney, Agent, or Firm*—Gardere Wynne Sewell LLP

(57) ABSTRACT

An electric motor-driven pump, particularly adapted for pumping condensate from refrigeration and air conditioning systems includes a reservoir body, a reservoir cover supporting an electric motor directly connected to a centrifugal pump impeller at one end of the motor rotor shaft and to a centrifugal cooling air fan at the opposite end of the motor rotor shaft. The motor is mounted on the reservoir cover and a motor cover mounted on the reservoir cover defines cooling air inlet and discharge ports for the flow of cooling air propelled by the fan. Efficient cooling air movement is obtained in a mechanically uncomplicated arrangement.

14 Claims, 3 Drawing Sheets

MOTOR DRIVEN PUMP WITH IMPROVED MOTOR COOLING AIR FLOW

BACKGROUND OF THE INVENTION

In the art of electric motor driven pumps, particularly enclosed or unitized motor driven pumps, such as used for condensate pumping applications, it is desirable to provide such pumps with an integral liquid reservoir at which is mounted the pump motor for driving a suitable pump impeller. Such pumps are desirably fabricated to be as inexpensive and compact as possible and typically include an AC electric motor directly driving the pump impeller and enclosed in a motor cover or shroud.

Heretofore, pumps of the general type described above have experienced inadequate motor cooling air flow characteristics. Since such pumps are typically fabricated of molded plastic components and are desired to be mechanically efficient, excessive heating of the motor and the associated housing structure is undesirable.

However, in accordance with the present invention an electric motor driven pump is provided which overcomes disadvantages of prior art pumps and provides several features which are advantageous.

SUMMARY OF THE INVENTION

The present invention provides an electric motor driven pump which is provided with an improved motor cooling air flow arrangement defined in part by a motor cover and a motor shaft mounted cooling air fan.

In accordance with one aspect of the present invention an electric motor driven pump, particularly adapted for refrigeration and air conditioning condensate pumping applications, is provided with a reservoir, a reservoir cover and a motor shroud or cover disposed over a direct drive electric motor which is drivingly connected to a pump impeller and to a motor cooling air fan on opposite ends of the motor rotor shaft. The motor shroud or cover is releasably connected to the reservoir cover for the pump reservoir and is provided with an advantageous arrangement of cooling air inlet ports and cooling air discharge ports. The overall construction of the pump is particularly compact and uniquely configured, including the motor cover and the cooling air flowpath therethrough.

Those skilled in the art will further appreciate the above-mentioned advantages and superior features of the pump of the present invention, together with other important aspects thereof, upon reading the detailed description which follows in conjunction with the drawing.

DETAILED DESCRIPTION OF A PREFERRED EMBODIMENT

Figure 1:
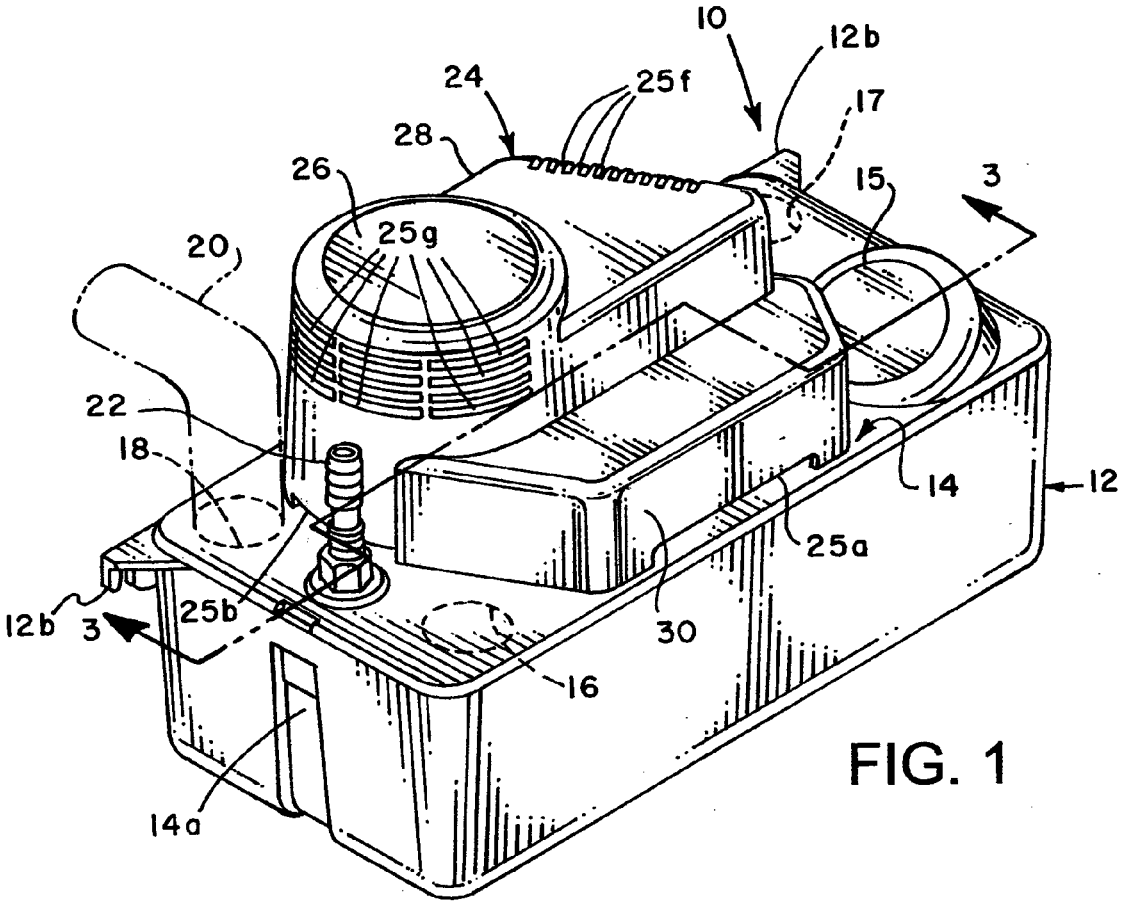
FIG. 1 is a perspective view of an electric motor driven pump in accordance with the present invention.

In the description which follows like parts are marked throughout the specification and drawing with the same reference numerals, respectively. The drawing figures are not necessarily to scale and certain features may be shown exaggerated in scale or in somewhat schematic or generalized form in the interest of clarity and conciseness.

Figure 3:
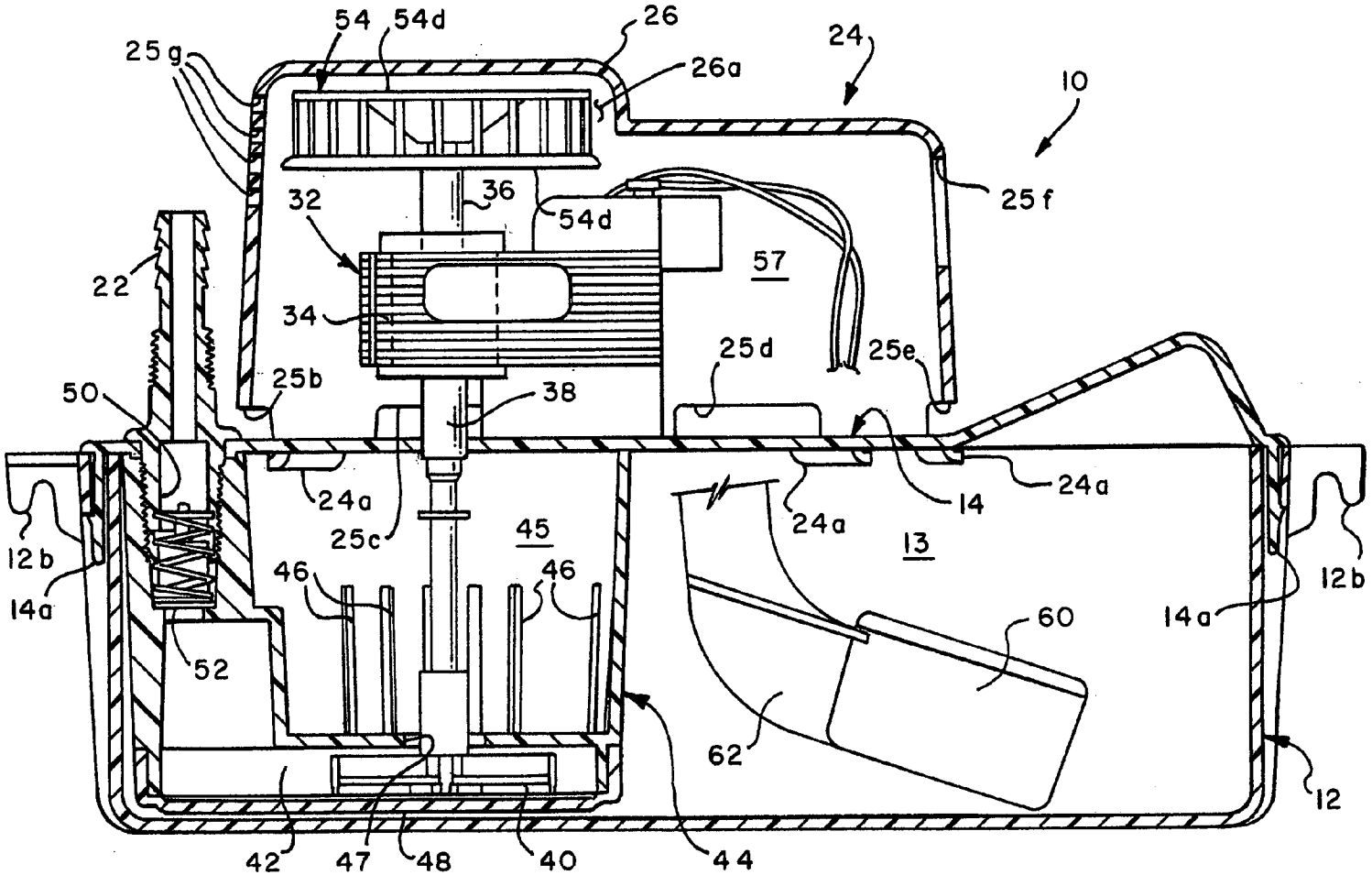
FIG. 3 is a section view taken generally along the line 3—3 of FIG. 1.
Figure 4:
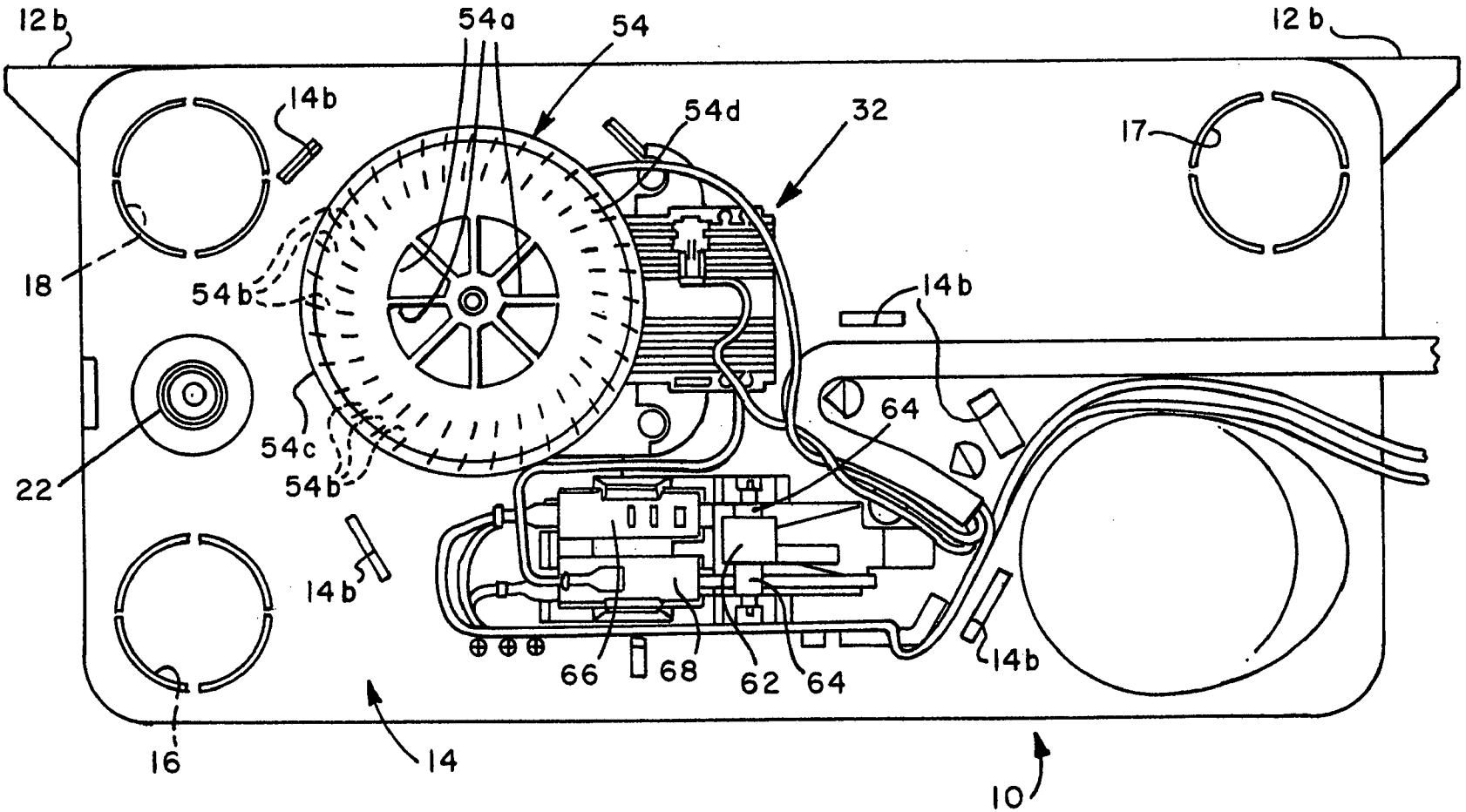
FIG. 4 is a plan view of the pump with the motor shroud or cover removed.

Referring to FIG. 1, there is illustrated an integral electric motor driven pump in accordance with the invention and generally designated by number 10. The pump 10 is particularly adapted for transferring liquids, such as condensate generated by air conditioning and refrigeration systems from condensate collection pans or the like, to an integral reservoir of the pump 10 comprising an open top hollow body 12 and forming a reservoir chamber 13, see FIG. 3. The reservoir body 12 is of generally rectangular configuration and is adapted to support a generally planar, removable cover member 14, as illustrated. Fluid inlet ports 16, 17 and 18, FIG. 4, are provided in the cover member 14 for selective connection to a fluid inlet conduit, such as the conduit 20 shown in FIG. 1 connected to the cover member 14 at the port 18. Fluid is discharged from the pump 10 by way of a discharge conduit 22, FIGS. 1 through 4, which is particularly adapted for forcible connection to a flexible fluid discharge hose, not shown. Reservoir cover 14 also includes a raised, somewhat angled, cylindrical cover part 15, FIGS. 1 and 2, to allow space within the reservoir chamber 13 for movement of a float member, to be shown and described further herein, for controlling a suitable float switch for the pump 10. Reservoir cover 14 is releasably connected to reservoir body 12 by opposed depending elastically deflectable latch members 14*a,* FIG. 3. Reservoir body 12 is provided with spaced apart integral mounting brackets 12*b*, FIGS. 1, 2 and 3.

Figure 2:
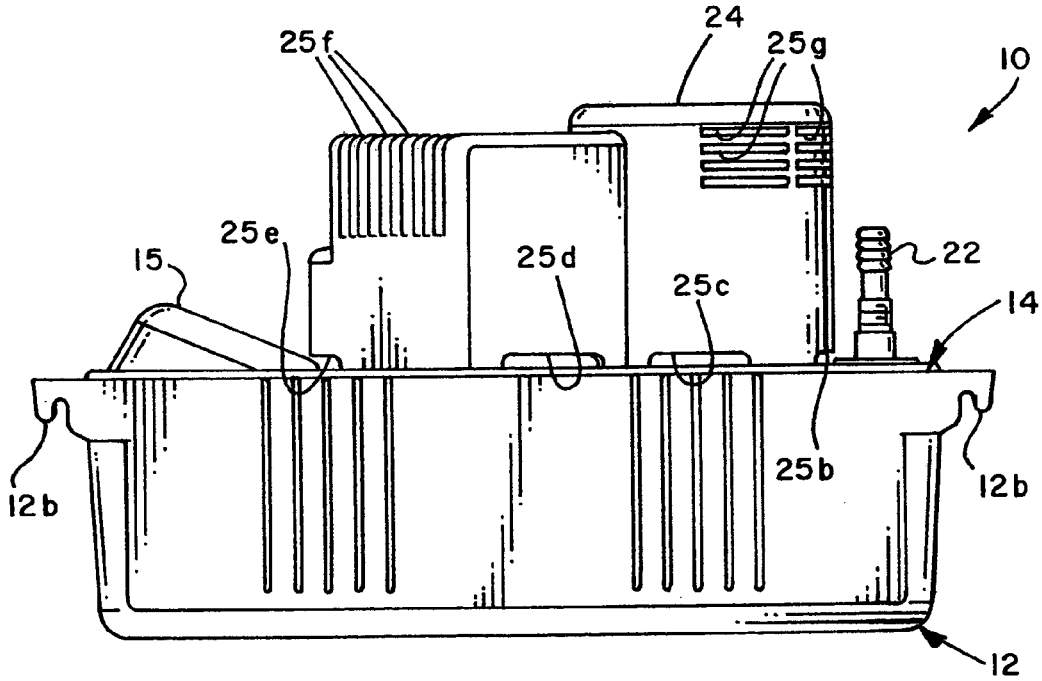
FIG. 2 is a rear elevation view of the pump shown in FIG. 1.

As shown in FIGS. 1 and 2, the pump 10 includes a motor shroud or cover, generally designated by the numeral 24 which is of unique construction and advantageously encloses an electric motor to be described further herein for driving a pump impeller of the pump 10. Motor cover 24 further forms an enclosure for control switches for operating the pump motor and an enclosure for a centrifugal motor cooling air fan which is directly connected to the pump motor rotor. The motor cover 24 is formed as a hollow shell-like member and includes a generally cylindrical part 26 which is formed integral with a first somewhat trapezoidal shaped part 28 and a second and also somewhat trapezoidal shaped part 30. Parts 26, 28 and 30 are integrally joined, preferably, and are also preferably formed of a suitable molded plastic which is the case for the reservoir cover 14 and the reservoir body 12 also. As shown in FIG. 3, the motor cover 24 is preferably joined to the reservoir cover 14 by spaced apart tabs 24*a*, which are insertable in cooperating slots 14*b,* FIG. 4, formed in the reservoir cover 14. Accordingly, the molded motor cover 24 may be easily snapped into and out of engagement with the reservoir cover 14.

As further shown in FIGS. 1, 2 and 3, motor cover 24 is provided with spaced apart cooling air inlet ports 25*a*, 25*b*, FIG. 1, 25*c*, 25*d* and 25*e*, FIG. 2. Cooling air inlet ports 25*b*, 25*c*, 25*d* and 25*e* are also shown in FIG. 3. Cooling air inlet ports 25*a*, 25*b*, 25*c*, 25*d* and 25*e* are delimited by reservoir cover 14. Further cooling air inlet ports 25*f*, comprising vertically oriented side by side parallel slots, are formed in cover part 28. Still further, cooling air discharge ports in the form of horizontally extending and vertically spaced apart, parallel slots 25*g* are formed in cover part 26, see FIGS. 1, 2 ad 3.

Referring further to FIG. 3, the pump 10 is provided with an electric motor, generally designated by the numeral 32, suitably mounted within motor cover 24 and on reservoir cover 14. Motor 32 includes a rotor 34 suitably mounted in spaced apart bearings, not shown in FIG. 3. Rotor 34 is operably connected to opposed coaxial rotatable motor output shaft parts 36 and 38. Shaft part 38 depends into reservoir 12 and is connected to a centrifugal pump impeller 40. Impeller 40 is disposed in a chamber 42 formed by a pump housing part 44 which is suitably connected to the underside of reservoir cover 14 and includes a reservoir sub-chamber 45 in communication with chamber 13 by way of vertical slot-like fluid inlet ports 46. Pump housing 44 is also provided with an impeller inlet passage 47 and a removable cover 48 to allow access to the pump impeller 40. The pump discharge conduit or fitting 22 is threadedly connected to housing 44 at a threaded bore 50. A suitable spring biased fluid discharge check valve 52 is interposed the housing 44 and the pump discharge conduit 22 to prevent back-flow from a pump discharge line, not shown, into the chamber 42. As shown in FIGS. 1 and 4, alternate fluid inlet ports 16 and 17 for a pump reservoir inlet line are provided in cover member 14 and are formed with so-called knock-out plugs, as illustrated in FIG. 4.

Motor shaft part 36 supports and is drivingly connected to a centrifugal fan member 54, FIGS. 3 and 4, for rotation upon energization of motor 32. Accordingly, at any time that the pump 10 is operating to discharge fluid from reservoir chamber 13, centrifugal fan 54 is operating to drawing cooling air into an interior space 57, FIG. 3, of motor cover 24 through the cooling air inlet ports 25*a*, 25*b*, 25*c*, 25*d*, 25*e* and 25*f* to provide a uniformly distributed flow of cooling air over the motor 32. Centrifugal fan member 54 is preferably of the squirrel cage type and includes at least inlet ports 54*a* and impeller blades 54*b*, FIG. 4. Cooling air propelled by fan 54 is discharged at the periphery 54*c* of the fan member 54 and then through the cooling air discharge ports 25*g*. Fan air inlet ports may be provided on opposed side plates 54*d* of fan 54, FIGS. 3 and 4. Thanks to the provision of the cylindrical cover part 26, the fan 54 is operable to reside in a space 26*a*, FIG. 3, which provides, in essence, a fan airflow discharge chamber which is in communication with the cooling air discharge ports 25*g*. As illustrated in FIGS. 1 and 3, a generous array of elongated horizontally oriented ports 25*g* is provided in motor cover part 26 adjacent fan 54 which ports extend generally parallel to the plane of a major part of the reservoir cover 14.

Referring still further to FIGS. 3 and 4, the pump 10 is provided with a float type control switch assembly which includes a float member 60 disposed in reservoir chamber 13 and connected to an actuating arm 62 which is supported for pivotal movement on trunnions 64, FIG. 4, and adjacent switch assemblies 66 and 68. The switch actuator, including float member 60 and arm 62, is operable to cause switches 66 or 68 to energize and de-energize motor 32 through a normal range of operation of the pump 10 dependent on the level of liquid in the reservoir chamber 13. If the liquid level in reservoir chamber 13 exceeds the normal range the other of switches 66 and 68 is operable to sound an alarm or otherwise shut off equipment which is producing the condensate flowing into the pump reservoir 12.

The construction and operation of the pump 10 is believed to readily understandable to those of ordinary skill in the art based on the foregoing description. Conventional engineering plastics may be used to fabricate parts such as the reservoir body 12, the reservoir cover 14, the motor cover 24, the pump reservoir housing 44 and cover 48 and the discharge fitting 22. Impeller 40 and centrifugal fan 54 may also be formed of molded plastic although other engineering materials normally used for pump and fan construction may be utilized. Thanks to the motor rotor driven fan 54 and its arrangement in the cover member or shroud 24, improved motor cooling air flow is obtained relatively easily and in an uncomplicated arrangement.

Those skilled in the art will recognize the above-described features and advantages of the invention and that various substitutions and modifications may be made without departing from the scope and spirit of the appended claims.

What is claimed is:

1. In a pump, a reservoir body including a reservoir chamber for collecting liquid, a reservoir cover releasably connected to and disposed over said reservoir body and including a fluid inlet port for conducting liquid to said reservoir chamber, an electric motor mounted on said reservoir cover including a first shaft part drivingly connected to a pump impeller and a second shaft part drivingly connected to a rotatable fan member and a motor cover disposed over said motor and said fan member, said motor cover being releasably mounted on said reservoir cover, said motor cover including a first plurality of vertically extending spaced apart slots forming cooling air inlet ports disposed in a first part of said motor cover and spaced from said reservoir cover, a second plurality of generally horizontally extending spaced apart slots spaced from said first plurality of slots and forming cooling air discharge ports and disposed in a second part of said motor cover and means forming at least one cooling air flow port formed between a third part of said motor cover and said reservoir cover.

2. The pump set forth in claim 1 wherein:

said second part of said motor cover comprises a generally cylindrical part and is provided with plural sets of horizontally extending spaced apart slots formed therein and adjacent to said fan member when said motor cover is disposed on said reservoir cover to provide for cooling air discharge from a cooling air discharge chamber formed by said second part of said motor cover.

3. The pump set forth in claim 2 including:

at least one cooling air inlet port formed between said second part of said motor cover and said reservoir cover.

4. The pump set forth in claim 3 wherein:

plural cooling air inlet ports are formed in and between said second part of said motor cover and said reservoir cover.

5. The pump set forth in claim 1 wherein:

at least one cooling air inlet port is formed between said first part of said motor cover and said reservoir cover.

6. The pump set forth in claim 5 wherein:

plural cooling air inlet ports are formed between said first part of said motor cover and said reservoir cover.

7. The pump set forth in claim 1 wherein:

said first part of said motor cover is integrally joined to said second part of said motor cover and said third part of said motor cover and said first part of said motor cover forms a cover for at least of a portion of said motor.

8. The pump set forth in claim 1 wherein:

said third part of said motor cover is integrally joined to said first and second parts of said motor cover and forms a cover for at least one control switch for controlling operation of said motor.

9. In a pump, a reservoir body including a reservoir chamber for collecting liquid, a reservoir cover releasably connected to and disposed over said reservoir body, an electric motor mounted on said reservoir cover including a first vertically extending shaft part drivingly connected to a pump impeller and a second vertically extending shaft part drivingly connected to a rotatable centrifugal fan member and a motor cover disposed over said motor and said fan member, said motor cover being releasably mounted on said reservoir cover, said motor cover including a plurality of vertically extending spaced apart slots forming cooling air ports disposed in a first part of said motor cover and spaced from said reservoir cover, a generally cylindrical second part of said motor cover forming a cooling air chamber and covering said fan member, means forming at least one cooling air inlet port formed between said motor cover and said reservoir cover, and plural sets of horizontally extending spaced apart slots formed in said second part of said motor cover adjacent to said fan member when said motor cover is disposed on said reservoir cover to provide for cooling air discharge from said cooling air chamber formed by said second part of said motor cover.

10. The pump set forth in claim 9 wherein:

said first part of said motor cover is integrally joined to said second part and said first part of said motor cover forms a cover for at least of a portion of said motor.

11. The pump set forth in claim 10 including:

a third part of said motor cover integrally joined to said first and second parts of said motor cover and forming a cover for at least one control switch for controlling operation of said motor.

12. In a pump, a reservoir body including a reservoir chamber for collecting liquid, a reservoir cover releasably connected to and disposed over said reservoir body, a fluid inlet port for conducting liquid to said reservoir chamber, an electric motor mounted on said reservoir cover including a first shaft part drivingly connected to a pump impeller and a second shaft part drivingly connected to a rotatable centrifugal fan member and a motor cover disposed over said motor and said fan member, said motor cover being releasably mounted on said reservoir cover, said motor cover including a plurality of vertically extending spaced apart slots forming cooling air inlet ports disposed in a first part of said motor cover and spaced from said reservoir cover, plural sets of generally horizontally extending vertically spaced apart slots forming cooling air discharge ports and disposed in a second generally cylindrical part of said motor cover and cooling air inlet ports formed by and between said first and second parts of said motor cover and said reservoir cover and by and between a third part of said motor cover and said reservoir cover.

13. The pump set forth in claim 12 wherein:

said first part of said motor cover is integrally joined to said second part and said third part of said motor cover, said first part of said motor cover forms a cover for at least a portion of said motor, and said second part of said motor cover forms a cooling air discharge chamber containing at least part of said motor and said fan member.

14. The pump set forth in claim 13 wherein:

said third part of said motor cover is integrally joined to said first and second parts of said motor cover and forms a cover for at least one control switch for controlling operation of said motor.

* * * * *